US008714364B2

(12) United States Patent
Hamelin

(10) Patent No.: US 8,714,364 B2
(45) Date of Patent: May 6, 2014

(54) METHOD OF MANUFACTURING A ROTOR FOR A SCREENING APPARATUS, A ROTOR AND A TURBULENCE ELEMENT FOR A ROTOR

(75) Inventor: Mathieu Hamelin, Montreal (CA)

(73) Assignee: Aikawa Fiber Technologies Trust (CA)

( * ) Notice: Subject to any disclaimer, the term of this patent is extended or adjusted under 35 U.S.C. 154(b) by 366 days.

(21) Appl. No.: 13/124,541

(22) PCT Filed: Aug. 5, 2009

(86) PCT No.: PCT/FI2009/050647
§ 371 (c)(1),
(2), (4) Date: Aug. 3, 2011

(87) PCT Pub. No.: WO2010/043756
PCT Pub. Date: Apr. 22, 2010

(65) Prior Publication Data

US 2011/0284430 A1 Nov. 24, 2011

(30) Foreign Application Priority Data

Oct. 15, 2008 (FI) ..... 20085967

(51) Int. Cl.
*D21D 5/26* (2006.01)

(52) U.S. Cl.
USPC ..... 209/306; 209/235; 209/273; 209/379; 209/385

(58) Field of Classification Search
USPC ..... 209/273, 306, 379, 385
See application file for complete search history.

(56) References Cited

U.S. PATENT DOCUMENTS

| | | | | | |
|---|---|---|---|---|---|
| 3,437,204 | A * | 4/1969 | Clarke-Pounder | ..... | 209/273 |
| 4,193,865 | A * | 3/1980 | Aario | ..... | 209/240 |
| 4,663,030 | A * | 5/1987 | Chupka et al. | ..... | 209/306 |
| 6,029,821 | A * | 2/2000 | Einoder | ..... | 209/306 |
| 2001/0045379 | A1 | 11/2001 | Gabl et al. | | |

FOREIGN PATENT DOCUMENTS

| | | | | | |
|---|---|---|---|---|---|
| DE | 40 28 772 | A1 | 11/1991 | | |
| DE | 4028772 | A1 * | 11/1991 | ..... | D21D 5/16 |
| EP | 0 764 736 | A2 | 3/1997 | | |
| EP | 0 852 637 | A1 | 7/1998 | | |
| EP | 1 143 065 | A2 | 10/2001 | | |
| EP | 1143065 | A2 * | 10/2001 | ..... | D21D 5/02 |

OTHER PUBLICATIONS

International Search Report for parent PCT Application PCT/FI2009/050647 mailed Dec. 28, 2009.
Written Opinion for parent PCT Application PCT/FI2009/050647 mailed Dec. 28, 2009.
International Preliminary Report on Patentability for parent PCT Application PCT/FI2009/050647 mailed Sep. 21, 2010.

* cited by examiner

*Primary Examiner* — Terrell Matthews
(74) *Attorney, Agent, or Firm* — Tech Valley Patent, LLC; John Pietrangelo

(57) ABSTRACT

The present invention relates to a method of manufacturing a rotor for a screening apparatus and a rotor structure for a screening apparatus. The rotor structure is particularly suitable in screening fiber suspensions of the pulp and paper industry. The apparatus relates to a novel rotor construction, and especially to a novel means of fastening a turbulence element on the rotor surface. The rotor is provided with easily replaceable turbulence elements so that at least a part of the rotor has at least one area —having a surface configuration different from the remaining rotor surface, on which area the turbulence element is fastened.

16 Claims, 6 Drawing Sheets

Figure 1:
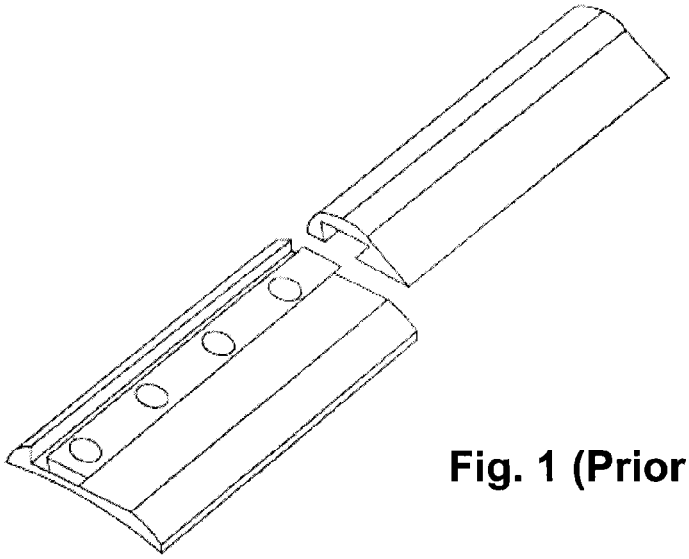
Fig. 1 (Prior art)

METHOD OF MANUFACTURING A ROTOR FOR A SCREENING APPARATUS, A ROTOR AND A TURBULENCE ELEMENT FOR A ROTOR

CROSS REFERENCE TO RELATED APPLICATIONS

This application is a national stage filing under section §371 of International Application No. PCT/FI2009/050647, filed on Aug. 5, 2009, and published in English on Apr. 22, 2010, as WO 2010/043756, and claims priority from Finnish application No. 20085967 filed on Oct. 15, 2008. The entire disclosures of these applications are hereby incorporated herein by reference.

BACKGROUND

1. Field of the Invention

The present invention relates to a method of manufacturing a rotor for a screening apparatus and a rotor structure for a screening apparatus. The rotor structure of the invention is particularly suitable for screening fibre suspensions of the pulp and paper industry. The apparatus according to the invention relates to a novel rotor construction, and especially to a novel means of fastening a turbulence element on the rotor surface.

2. Description of Related Art

The screening apparatus used nowadays in the pulp and paper industry is almost without exception a pressurized screening device i.e. a so-called pressure screen into which the pulp to be screened is introduced in a pressurized state. The most popular pressure screens comprise a stationary screen cylinder and a rotating rotor in cooperation therewith. The purpose of the screen cylinder is to divide the fresh pulp or the fibre suspension entering into the screening cavity where the rotor rotates into an acceptable fibre fraction called the accepts, and a rejectable fibre fraction called the rejects. The screen cylinder as well as, naturally, the rotor are located inside a screen housing having ducts for both the fresh fibre suspension, the accepts, and the rejects. Normally, the inlet duct or inlet for the fibre suspension is at one end of the screen housing, whereby the rejects outlet is at the opposite end of the housing. The accepts outlet is in communication with the accepts cavity, which is positioned at the opposite side of the screen cylinder in relation to the screening cavity. The purpose of the rotor is to create turbulence, and positive and negative pressure pulses in the fibre suspension to be screened. This purpose is achieved by providing the rotor with specific turbulence elements.

At this stage it should be understood that screening devices whose screen cylinder is rotary, and the means creating turbulence and pressure pulses is stationary, are also known, though more seldom used. The word 'rotor' is supposed to cover also this kind of turbulence creating means, as they can be said to rotate in relation to the screen cylinder. Also it should be understood that the term 'screen cylinder' covers all screening means having openings, i.e. holes or slots, for instance, and having a rotationally symmetric shape. Thus also conical or frusto-conical shapes are covered, and also known from prior art.

The pressure screen is most often positioned such that its shaft is in an upright position. However, the pressurization of the fibre suspension makes it possible to position the shaft of a pressure screen in any direction including a horizontal direction. Due to the pressurized feed of the fibre suspension, it may be introduced into a pressure screen to the top, to the bottom or to the centre region thereof.

The pressure screens may also be divided into two groups based on the direction of the accepts flow through the screen cylinder. When the accepts flow is radially outwardly, the screen is called an outflow screen, and when the accepts flow is radially inwardly, the screen is called an inflow screen.

In accordance with the prior art there are, in principle, two different types of rotors, which are commonly used in the pulp and paper industry and the intention of which, as known, is to maintain the screen surface clean, in other words to prevent blockages of perforations in the screen surface, and to maintain sufficient turbulence in the screening cavity containing fresh i.e. non-screened fibre suspension. The rotor types may be called an open rotor and a closed rotor. An example of an open rotor is disclosed in U.S. Pat. No. 4,193,865 in which the rotor is arranged inside a cylindrical, stationary screen cylinder. The rotor comprises a concentric shaft and a number of turbulence elements in the form of foils extending close to the surface of the screen cylinder. Each foil is supported on the shaft by means of a pair of arms extending through the cavity, which contains fresh pulp when the screening apparatus is in operation. The foils of the above-mentioned patent form an angle with the shaft of the rotor and the axis of the screen cylinder. However, the foils may also be arranged parallel to the axis. While the foil, or the fibre suspension in relation to the foil, is moving, the leading surface of the foil subjects the screen surface to a positive pressure pulse, which pushes acceptable fibres through the screening openings, and the trailing surface of the foil subjects the screen surface to a negative pressure pulse for opening the perforations of the screen surface or, rather, for preventing the fibres from accumulating on the screen surface and from blocking the screening openings by means of creating a back flow from the accepts cavity to the screening cavity.

An example of the other rotor type i.e. the closed rotor has been discussed, for instance, in U.S. Pat. No. 3,437,204, in which the rotor is a substantially cylindrical closed body positioned inside a screen cylinder. The rotor surface is provided with turbulence elements, i.e. protrusions, which, in this example, are almost hemispherical in form. In this kind of an apparatus, the fresh fibre suspension is fed between the rotor and the screen cylinder, whereby the protrusions of the rotor, the so-called bumps, in this case, create turbulence and pressure pulses towards and away from the screen cylinder. In other words, the leading surface of each bump pushes the pulp towards the screen cylinder and the trailing surface of the bump induces a suction pulse that draws the fibre accumulations from the openings of the screen cylinder. Most often the closed rotor surface is cylindrical. In a broader sense, also rotationally symmetrical rotor surfaces may be discussed, as there are rotors having a frusto-conical shape or a dome shape. Additionally, there are also rotors not literally having a rotationally symmetrical shape. One such option is a so-called S-rotor, which is formed of two identical cylinder halves attached to each other such that two radially, or substantially radially, arranged surfaces join the half-cylindrical surfaces. Also, there are rotors formed of a number of planar, possibly rectangular, members arranged to form an annular surface. Further, there are rotors, which are formed of a number of discs attached one on top of the other. The discs have an ellipsoidal outer surface, and the discs are positioned such that the foci of two adjacent discs are not situated in the same plane running along the rotational axis of the rotor.

As to the shape of the turbulence elements arranged on the surface of a closed rotor there is a huge number of different alternatives. A first alternative is a turbulence element, which is a more or less hemispherical bump, as already discussed above. A second alternative is formed of an axially or spirally extending ridge, which still has a rounded top surface. A third alternative is formed of a grooved rotor surface where the groove is formed of a bottom surface, an inclined side surface and a side surface perpendicular to the envelope surface of the rotor. The groove is either axially oriented or spiral. Depending on the width of the bottom surface one could also call the rotor surface not grooved but ridged. A fourth alternative is formed of a protrusion, which, in a way, resembles the above ridged rotor except that the ridge is cut such that the length of a protrusion is of the order of 50-200 mm. This protrusion type has a number of variations. The leading surface of the protrusion may be perpendicular to the rotor surface or inclined; it may also be axially oriented or inclined in either direction. The protrusion may, or may not, have a top surface either parallel to the rotor envelope surface or inclined in either direction. The protrusion also has a trailing surface which is either inclined or perpendicular to the rotor surface. Thus one has four variables, each having several options, whereby the number of possible alternatives for the shape of a protrusion is very high. And finally, as the fifth alternative, where the surfaces (leading, top and trailing surfaces) of the protrusion may be arranged to be smoothly changing whereby they form a curved surface being formed of several sections each having (possibly) a different radius. In fact, the fifth alternative is formed by combining the foil of an open rotor with a closed rotor, as here the foil has been (with possibly minor modifications to the surface facing away from the screen surface) attached on the surface of the rotor. Thus, when taking into account the above mentioned surface options, though they may also comprise planar sections, the number of possible shapes of the turbulence elements grows even higher.

Yet one more rotor type may be mentioned. It is, in a way, a combination of an open rotor and a closed rotor, as the rotor has both types of turbulence elements i.e. both protrusions, which are fastened from their bottom on a closed rotor surface, and foils being attached by means of short arms on the rotor surface, or even by means of longer arms on the rotor shaft, whereby the rotor can be called either a partially closed or a partially open rotor.

U.S. Pat. No. 6,029,821 discloses a rotor structure for screening fiber suspensions. The rotor is comprised of a rotor body comparable to s rotor shaft to which radial arms for rotor foils have been fitted. The foils are arranged at a distance from the rotor body. The foils have been attached to the arms by means of screws extending through the foil from the foil surface facing the screen cylinder. The radially inner end of the arms is inserted in an opening in the rotor body, and welded therein.

U.S. Pat. No. 4,663,030 discloses a disk rotor for paper making stock screens. The interior of the screen cylinder is for the most part open, as the rotor has been formed of a shaft and a planar disk arranged at the upper end of the shaft. The disk extends close to the screen cylinder inner surface such that rotor foils may be attached on the outer circumference of the disk and rotate in close proximity of the screen cylinder. The foils are attached on the disk by means of bolts extending through the foils from the foil surface facing the screen cylinder. The disk surfaces to which the foils are to be fastened are flattened.

EP-A2-1 143 065 discloses a screening rotor formed of a rotor body (corresponding to a rotor shaft), and foils attached by means of arms to the rotor body. The foils are always arranged at a distance from the rotor body

BRIEF SUMMARY OF INVENTION

The present invention relates, irrespective of the cross sectional shape of the turbulence element or of its length, to a turbulence element, which is attached on the surface of an at least partially closed rotor. As to closed, or partially closed, rotors the turbulence elements are fastened typically on the closed surface of the rotor by means of welding. This means that the turbulence elements must be manufactured such that their bottom surface facing the closed rotor surface has a curvature matching that of the rotor surface. At this stage it has to be taken into account the fact that when designing a pressure screen the designer cannot design a pressure screen for one customer and one production rate only, but he has to be able to fulfil the requirements of pulp or paper mills having production rates that differ a great deal from each other. The only way the designer is able to accomplish the above requirement is to design a series of pressure screens matching the varying production rates of different customers. Normally the way to alter the production rate of a pressure screen is to alter either the diameter or the height of the screen cylinder, or both. This means, in practice, that similar turbulence elements cannot be used for all rotors of a series of pressure screens, when the diameter of the rotor changes. Thereby, in principle, each rotor diameter requires specifically manufactured turbulence elements, which complicates the manufacturing process of the elements. Another disadvantage in fastening the turbulence elements by welding can be seen when the elements have worn to such a degree that they should be repaired. If it is decided that the elements have to be changed to totally new ones, opening the weld seams all around the element takes time and is a cumbersome task.

A turbulence element structure where the element is easily replaceable is known from prior art (See FIG. 1). The turbulence element is fastened by means of a specific support on the rotor surface. The fastening of the element to the support takes place by means of a dovetail insert arranged on the support and a corresponding dovetail groove arranged in the turbulence element. The element may be pushed on the support such that the dovetail insert fits into the dovetail groove, whereafter the turbulence element is secured by means of holding screws at both ends of the turbulence element. The turbulence element support is fastened on the rotor surface by means of welding, and the dovetail insert on the support by means of screws extending from the outer surface of the insert through the support inside the rotor shell into specific nut-like elements. This kind of fastening of the turbulence element makes the replacement of the turbulence element easy, but it still has a few disadvantages. Firstly, since the support inner surface follows the rotor surface, a support designed for one rotor diameter cannot be used in connection with a rotor having another diameter. If the support radius and the rotor radius do not match exactly, a gap is formed between the support and the rotor surface. Since the gap is apt to collect fibres, its presence is not desired. Secondly, since the support of the prior art covers a clearly larger area on the rotor surface than the turbulence element i.e. it extends at both circumferential sides of the turbulence element outside the element, the support is also inclined to wear whereby the support has to be changed from time to time resulting in a cumbersome task corresponding to loosening a welded turbulence element from the rotor surface of another well-known prior art rotor. Thirdly, each turbulence element requires a free area having the length and width of the element to the side of the support such that the turbulence element can be pushed on the dovetail support. As the dovetail support is most often axial, the free area has to be arranged at the axial side of the support. Thus this prior art turbulence element and its fastening by means of a specific support, though bringing about an advantage over earlier prior art, also brings about at least three disadvantages: i.e. a specific support for each rotor diameter, the support requiring replacement, and the installation of the turbulence element requiring free space at the side of the support.

DE-A1-40 28 772 discloses a rotor for a screening apparatus solving the problems involved in the above discussed prior art rotors using turbulence elements fastened by means of separate supports on a surface of an at least partially closed rotor. The rotor of the DE reference is formed of a closed cylindrical body through which openings for turbulence elements have been made. The turbulence elements are provided with a turbulence creating raised portion and a foot portion to be fitted in the opening. The openings are surrounded by a recess in the rotor body surface. The size of the recess is such that the turbulence element fills the recess, and joins smoothly to the rotor surface. The turbulence elements are fastened to the openings by means of shrink-fitting and/or gluing.

However, even the turbulence element structure discussed in the German reference and especially its fastening on the rotor surface has problems, or weaknesses. The DE reference teaches that the turbulence element is fastened to the openings through the rotor body by means of shrink fitting and/or gluing. This means in practice that the element when worn has to be removed by drilling. The drilling may be done from inside the rotor, where the space for the drilling is very limited for accurate positioning of the drill to the center of the foot part of the turbulence element and for exact aligning of the drill with the foot part. On the opposite surface, there is plenty of room for the drill, but the positioning of the drill so that the drill would penetrate through the raised portion in the center of the foot part in the opening of the rotor body is, in practice, impossible due to the uneven wear of the turbulence element. In other words, in both cases the removal of the turbulence element by drilling most probably results in the drill hitting the rotor body slightly at a side of the opening therein. This would mean either increasing the opening size for the next turbulence element, which would mean the need of a newly dimensioned foot part for the turbulence element, or filling the opening in the rotor body by means of, for instance, welding, and then re-drilling it to the proper dimensions.

An object of the method, the rotor structure and the turbulence element structure of the invention is to correct at least some of the deficiencies and/or disadvantages of prior art rotor structures and their manufacture. The basic problem the rotor of the present invention solves relates to difficulties in removing and replacing worn turbulence elements attached on the surface of an at least partially closed rotor.

In accordance with a first preferred embodiment of the present invention the rotor surface is provided with ridges, in more general terms projections, so called anchoring means to which the turbulence element is fastened. Further, the turbulence element is provided with a cavity into which the anchoring means fits when the element is positioned on the rotor surface.

The turbulence element of the present invention fulfils the requirement of easy replaceability, and since the turbulence element covers the means by which it is attached on the rotor surface, it is the only component that is subject to wear.

BRIEF DESCRIPTION OF THE DRAWING FIGURES

Figure 2:
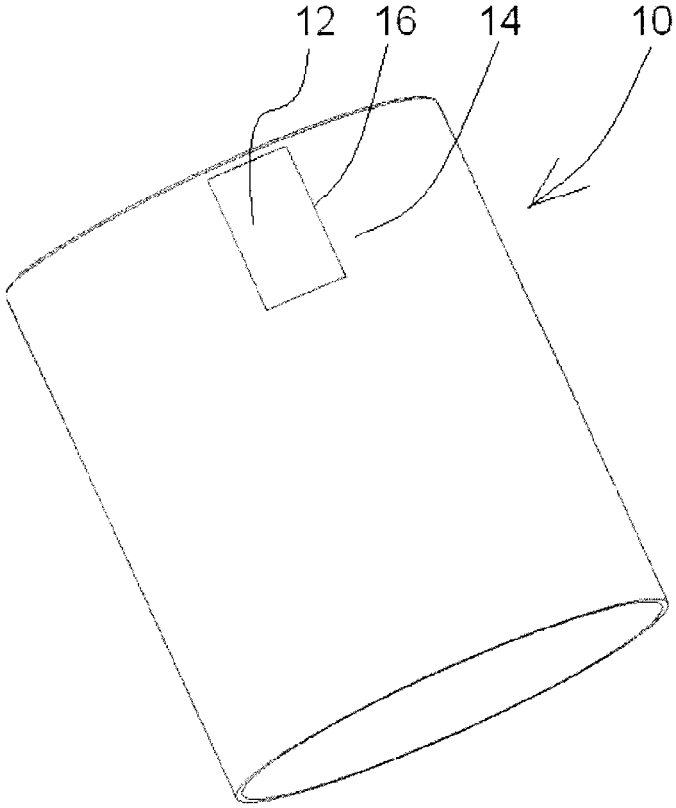
Figure 3:
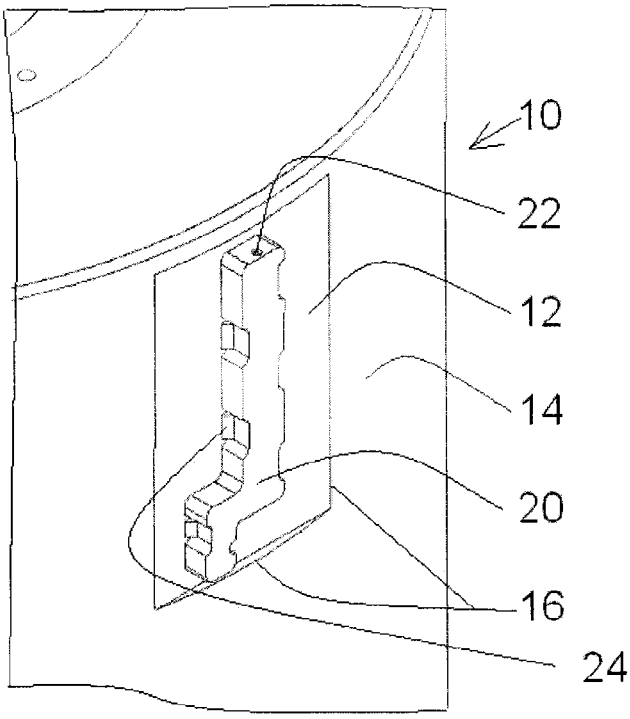
Figure 4:
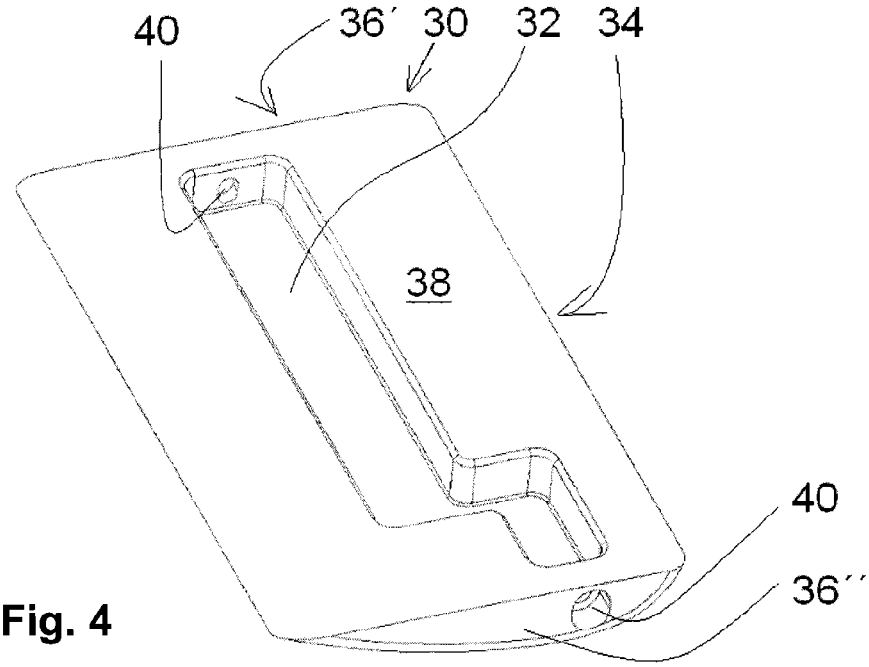
Figure 5:
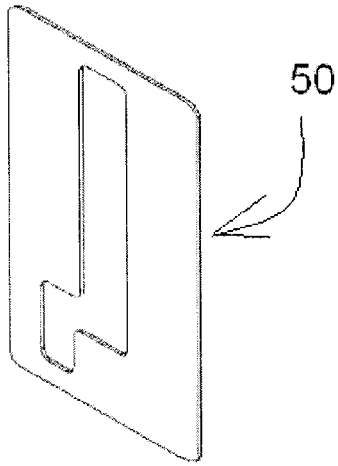
Figure 8:
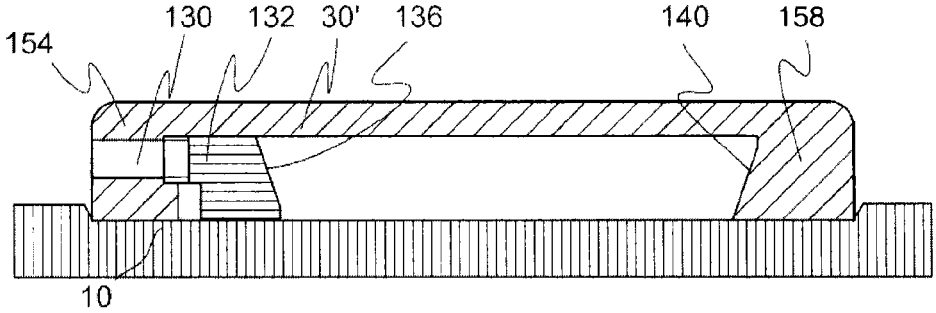
Figure 6:
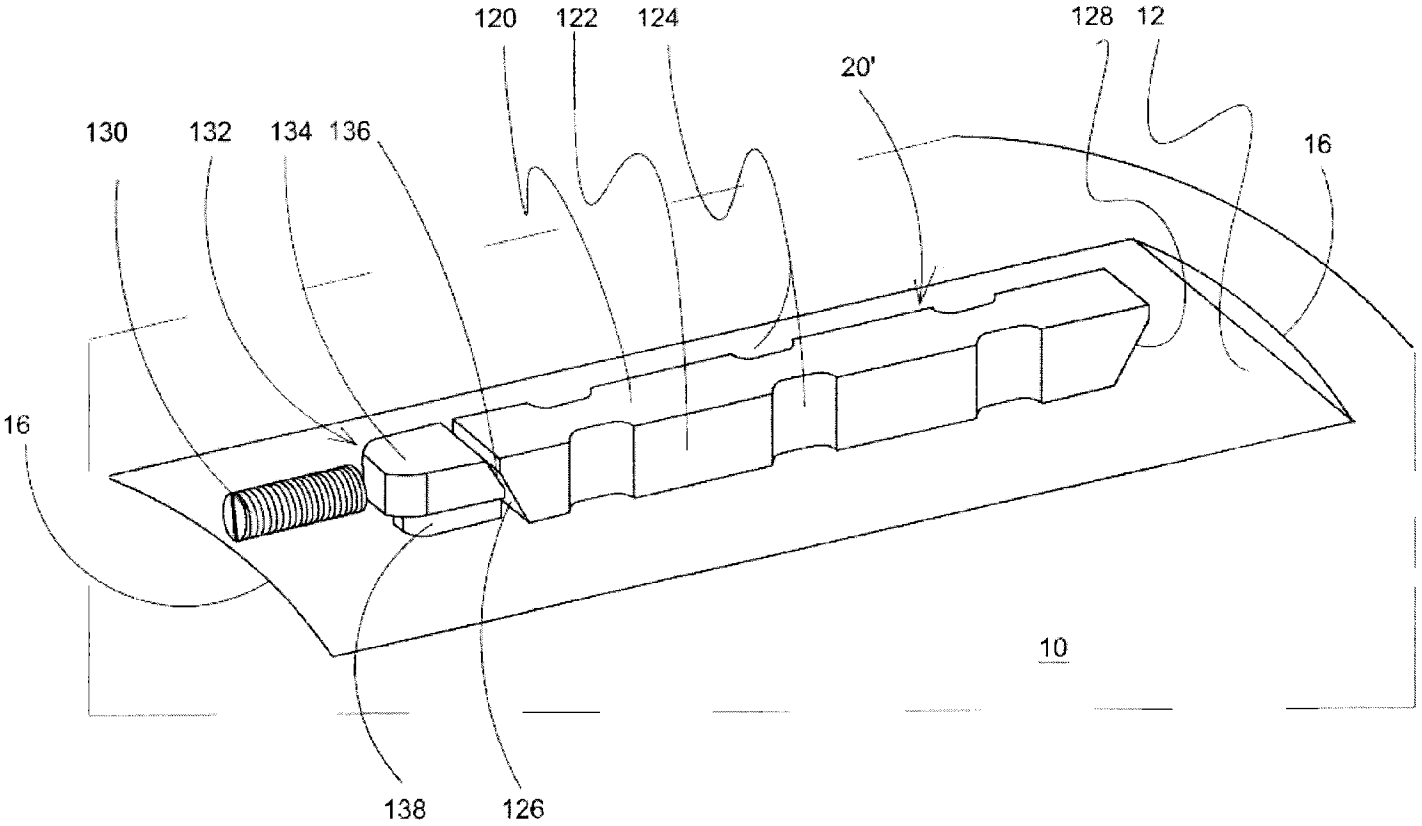
Figure 7:
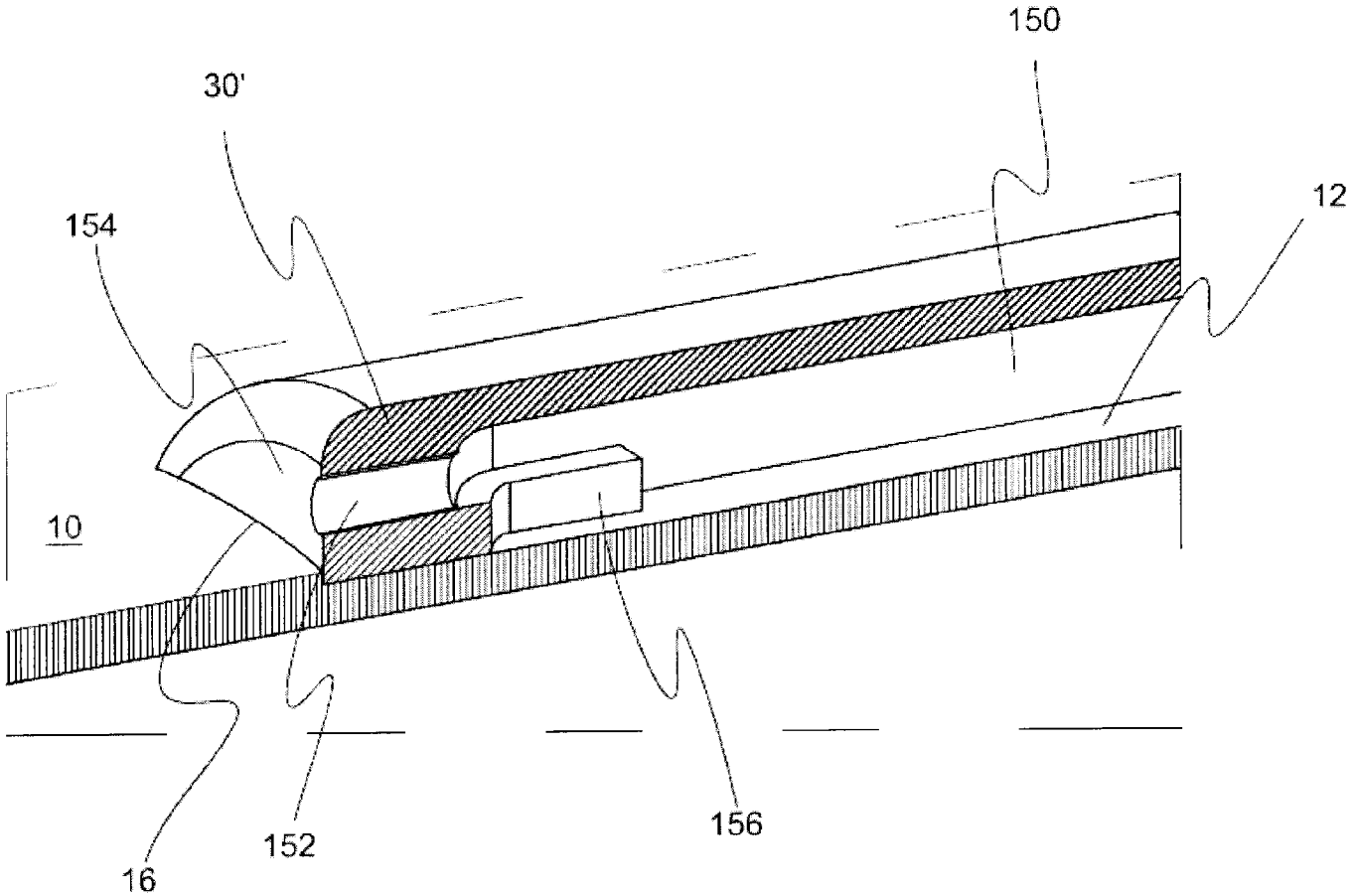
Figure 9A:
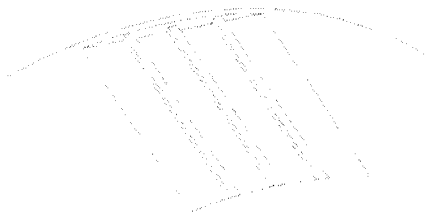
Figure 9B:
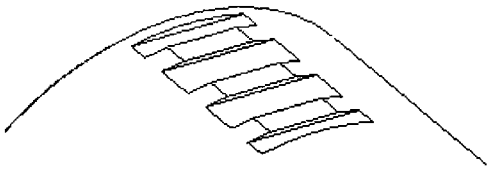
Figure 9A:
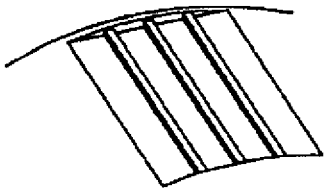
Figure 9B:
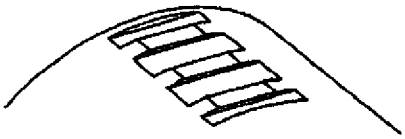

This and other embodiments of the present invention are discussed in more detail in the following by referring to the appended drawing figures of which FIG. 1 illustrates a turbulence element fastening in accordance with prior art, FIG. 2 illustrates a partial 3-D view of the rotor surface used in connection with the present invention, FIG. 3 illustrates the rotor surface, as a partial 3-D view, provided with a preferred anchoring means in accordance with a first preferred embodiment of the present invention, FIG. 4 illustrates a turbulence element, as a 3-D view, in accordance with the first preferred embodiment of the present invention, FIG. 5 illustrates a shim that may be used with the first preferred embodiment of the present invention, FIG. 6 illustrates the rotor surface, as a partial 3-D view, provided with another preferred anchoring means in accordance with a second preferred embodiment of the present invention, FIG. 7 illustrates a partial cross section of a turbulence element fastened on a rotor surface in accordance with the second preferred embodiment of the present invention, FIG. 8 illustrates an axial cross section of a turbulence element positioned on the rotor surface such that the anchoring means has been cut away, and FIGS. 9*a* and 9*b* illustrate two further embodiments of the rotor surface configuration at the areas where the turbulence elements are to be fastened.

DETAILED DESCRIPTION OF ASPECTS OF THE INVENTION

In accordance with FIG. 2 the rotor of the first embodiment of the present invention is formed of a rotationally symmetrical body, like for instance a cylinder. Other possible options are conical, frusto-conical, egg-shaped, truncated egg-shape, etc. just to name a few alternatives. Also other surface options than rotationally symmetrical ones may come into question, as discussed already above in paragraph (007). However, the various options both above and in paragraph (007) are to be understood as examples only, whereby also other closed rotor shapes having a closed surface may be utilized in connection with the present invention. In accordance with FIG. 2 the surface of the rotor 10 is provided with areas 12 (only one such area has been shown) having a configuration, in this case, a curvature different from the configuration/the curvature of the remaining areas 14 of the rotor. The curvature of the remaining areas 14 is defined by the diameter of the rotor. The areas 12 are the ones that will secure the turbulence elements when the rotor 10 is finished and ready for use. Typically, the turbulence elements cover about 10-50%, preferably about 15-35% of the circumferential area of the rotor surface, i.e. of the area facing the screen surface. The reason for providing the rotor surface with areas 12 of different configuration/curvature is that when all rotors in a series of rotors having different diameters have areas 12 having the same configuration/curvature throughout the rotor series, only one type of turbulence element is needed as it matches on all rotors. Naturally, if there are other reasons to change the configuration of the turbulence element, it can still be done, but the bottom surface of the element may be maintained i.e. need not be changed. Thus the manufacture of the turbulence element is in the least somewhat easier.

When considering the required configuration/curvature in view of manufacturing or forming of the areas 12 having the different configuration/curvature, it can be concluded that in such a case that the rotor is cylindrical, the radius of the area 12 should preferably be at least the radius of the largest rotor cylinder in the series of pressure screens. In that case all rotors except the largest one should be machined/formed at the positions where the turbulence elements are supposed to be located. If the radius of the area 12 is made larger, all rotors have to be machined/formed. Depending on the machinery used for the machining it may be easiest to machine the turbulence element seats i.e. the areas 12 flat or planar i.e. having an infinite diameter. However, it has to be understood also that, particularly, if the rotor is manufactured by casting, it is possible that the surface of the rotor is provided with projections having a curvature smaller than the rest of the rotor.

In accordance with the embodiment shown in FIG. 3 the rotor surface is provided at the machined areas 12 with anchoring means 20 for fastening the turbulence elements on the rotor. The anchoring means 20 may be attached on the rotor 10 surface by ordinary means of fastening, like welding, gluing, soldering, riveting or by means of screws or bolts. As the anchoring means 20 are totally covered by the turbulence element the rivets, bolts or screws may be fastened such that the heads of the rivets or bolts or screws are visible on the anchoring means 20. Thus there is no risk of fibres collecting at the heads of the fastening means. The anchoring means 20 are dimensioned such that they fit totally inside the boundaries 16 of the areas 12, preferable leaving a certain clearance therebetween. The depressions in the side surfaces of the anchoring means are for the welds 24 so that the turbulence elements need not be provided with an additional space for the welds.

In accordance with FIG. 4 the turbulence element 30 in accordance with a preferred embodiment of the present invention is provided with an empty cavity 32 the dimensions of which preferably, but not necessarily, correspond to the outer dimensions of the anchoring means 20. The size and shape of the turbulence element 30 can be whatever required by the operating conditions of the rotor 10. However, it is advantageous, though not necessary, that the perimeter of the turbulence element 30 corresponds to the boundaries 16 of the area 12 such that the turbulence element 30 covers the area 12 substantially totally. In other words, all turbulence element types discussed earlier in this specification can be used as well as others, which have not been discussed. Thus the axial length of the element 30 may be anything between a few centimeters up to the entire length of the rotor 10. Thereby it is also possible that the turbulence element is not fastened by means of a single anchoring means but by means of two or more anchoring means, which, depending on the dimensions of the turbulence element, may be positioned either axially, circumferentially or spirally or in any combination thereof on the rotor surface. The turbulence element 30 can be considered to be formed of three different parts: the working surface 34, which is the substantially circumferentially extending radially outer surface of the turbulence element 30 facing the screen cylinder, along which the pulp to be screened flows when the screening apparatus is in operation; side walls 36' and 36" at the axial ends of the turbulence element 30, the side or end walls 36', 36" being normally, but not necessarily, substantially at right angles to the rotor surface; and the bottom surface 38, which has an opening for the anchoring cavity 32 and the configuration/curvature, which corresponds to the configuration/curvature of the rotor surface at the position receiving the turbulence element 30, either a machined surface or a non-machined surface. In other words, the bottom surface faces the rotor surface, and lies against it. An essential feature of this preferred embodiment of the invention is that the bottom surface surrounds entirely the opening into the cavity thus forming a continuous rim for the opening.

Preferably, but not necessarily, the side walls 36' and 36" of the turbulence element 30 are provided with holes 40 opening into the anchoring cavity 32. The anchoring means 20 are preferably provided with tapped holes 22 (see FIG. 2) for receiving fastening screws that hold the turbulence element 30 in position on the anchoring means 20 and also against the rotor surface 12. The holes 40 at the side or end surfaces 36' and 36" of the turbulence element 30 may be elongated in substantially radial direction of the rotor, i.e. in a direction substantially at right angles to the element bottom surface 38 whereby it is possible to arrange shims 50 (see FIG. 5) between the turbulence element 30 and the rotor surface 12 if the height of the element 30 needs adjustment. Also in case the fit between the anchoring means 20 and the turbulence element 30 is not a tight one, it would be possible for the shim 50 to be wedge-shaped, whereby the height of the element 30 at its leading (in circumferential direction) part could be made grow more than at its trailing part, or vice versa. Preferably, the holes 40 at the side walls 36', 36" of the turbulence element 30 and the fastening screws are designed together such that the heads of the fastening screws, when the screws are tightened, are flush with the side wall 36', 36" of the turbulence element 30. This ensures that the chances of fibres to collect to the hole/screw head are minimized.

Also other means for fastening the turbulence element than screws may be used. An example is a locking pin that is pushed through a hole in the side wall of the turbulence element in a blind hole or a through-bore in the anchoring means. The locking pin may extend at a certain distance (corresponding that of a screw) inside the anchoring means or it may extend through the anchoring means into a hole in the opposite side wall of the turbulence element. When using the locking pin the hole ends in the turbulence element side walls should preferably be closed by means of small threaded covers or by a small weld dot, which may be drilled open when the turbulence element needs to be replaced. Another option is to arrange the locking pin to extend from the first side wall of the turbulence element to the second side wall thereof, whereby a small weld dot at either end of the pin is sufficient to lock it in place.

Yet another means of fastening the turbulence element is to arrange a blind hole at an end of the anchoring means, and a corresponding stationary pin at an end of the anchoring cavity of the turbulence element. The other end of the turbulence element could be attached to the anchoring means by a removable pin or screw.

FIG. 6 illustrates a rotor 10 provided with anchoring means 20' in accordance with another preferred embodiment of the present invention. Just like in the embodiment discussed in connection with FIGS. 2 and 3 a machined or otherwise formed area 12 is provided in the generally rotationally symmetrical or usually cylindrical surface 14 of the rotor 10. The area 12 is provided with anchoring means 20', which has been attached on the rotor surface by welding, gluing, soldering, riveting or by bolts or screws extending in or through the shell of the rotor 10. In this embodiment the anchoring means 20' is positioned preferably, but not necessarily, axially on the rotor surface. The anchoring means 20' has a top surface 120, which is preferably but not necessarily parallel with the bottom surface of the anchoring means. The bottom surface of the anchoring means is lying against the surface of the area 12 on which the anchoring means 20' is attached. The side surfaces 122 of the anchoring means 20' have, in this embodiment, depressions 124 so that possible welds for fastening the anchoring means 20' on the rotor surface may be positioned in the depressions 124 so that there is no need to provide the anchoring cavity of the turbulence element with any specific additional spaces for the welds. Both longitudinal ends of the anchoring means 20' are provided with an inclined surface 126 and 128 such that the inclined surfaces 126 and 128 form an obtuse angle with the bottom surface of the anchoring means 20'. In other words, the top surface 120 of the anchoring means 20' is longer than the bottom surface i.e. the surface lying against the rotor surface. One surface 128 of the inclined surfaces i.e. one of the ends of the anchoring means 20' may be positioned closer to the axial boundary 16 of the formed area 12 than the opposite surface 126 or end facing its boundary 16. The thus attached anchoring means 20' forms by means of its end surfaces 126 and 128 the first element of the dovetail joint used for attaching the turbulence element 30' on the rotor surface.

FIG. 6 also illustrates the separate locking members used in cooperation with the anchoring means 20'. The separate locking members comprise a locking screw 130, and a locking block 132. The locking block 132 is a T-shaped member having a wider head part 134, and a narrower foot part 138. The locking block 132 has two ends, a first end having an inclined surface 136 that is designed to cooperate with the inclined surface 126 of the anchoring means, and a second end having a surface cooperating with the screw 130. The locking block 132 further has a top surface with which the inclined surface 136 forms an obtuse angle. The obtuse angle of the surface 126 of the anchoring means 20', and the one of the locking block 132 are preferably equal.

FIG. 7 illustrates a partial cross-section of a turbulence element 30' placed on the rotor 10 such that the anchoring means (discussed in FIG. 6) on the formed surface area 12 of the rotor has been cut away. In other words, FIG. 7 shows, mainly, the internal structure of the turbulence element 30'. More specifically, FIG. 7 illustrates a first end of the turbulence element 30' where the locking members are situated when the turbulence element 30' is attached on the rotor surface. Like in the embodiment discussed in FIG. 4, the turbulence element 30' has an internal anchoring cavity 150 for housing the anchoring means. Thus the size and shape of the anchoring cavity 150 corresponds generally to that of the anchoring means. At the first end of the anchoring cavity 150 housing the locking members, the turbulence element 30' is preferably provided with a threaded hole 152 through a first end or side wall 154 of the turbulence element 30'. The inside of the turbulence element 30' is provided, at the first end of the anchoring cavity 150 where the threaded hole 152 is located, with a collar 156 that forms preferably a symmetrical U-shaped inward extension of the circumference of the internal cavity 150 of the turbulence element 30'. The dimensions of the collar 156 have been chosen to match with the ones of the T-shaped locking block 132 (discussed in FIG. 6) so that the block 132 can be placed at the first end of the cavity 150. In other words, the height of the collar 156 corresponds to the height of the foot part 138 of the locking block 132, the distance from the collar 156 to the top (upper surface in FIG. 7) of the cavity 150 corresponds to the height of the head part 134 of the locking block 132, and the distance between the legs of the U-shaped collar 156 corresponds to the width of the foot part 138 of the locking block 132. The length of the collar 156 may be more freely chosen, and it is preferably somewhat more than the length of the locking block 132. Thus, the end of the internal cavity 150 has a T-shaped cross section corresponding to the T-shape cross section of the locking block. Naturally, the dimensions of the locking block 132 and the T-shaped cavity have been chosen such that sufficient running tolerances are ensured. It should be understood from the explanation above that the height is measured in substantially radial direction of the rotor, and the length in substantially axial direction of the rotor, or, more generally, in the axial direction of the anchoring means or turbulence element.

The second end wall 158 of the turbulence element (best shown in FIG. 8), i.e. a second end of the cavity 150 opposite to the collar 156 and the threaded hole 152 is provided with an inclined surface 140 designed to cooperate with the surface 128 (see FIG. 6) of the anchoring means. The inclined surface 140 forms an acute angle with the top surface (upper surface in FIGS. 7 and 8) of the anchoring cavity 150. Thus the inclined surface 140 at the second end of the cavity 150, and the inclined surface 136 of the locking block 132 form the second dovetail joint elements.

It should be understood that also in this preferred embodiment of the invention an essential feature of the invention is that the bottom surface surrounds entirely the opening into the cavity thus forming a continuous rim for the opening.

The turbulence element 30' is installed on the rotor as explained in the following by referring to FIGS. 6, 7, and 8. Firstly, like in the already earlier discussed embodiments, the rotor surface 10 is preferably provided with an area 12 having a curvature common to all, or substantially all rotor sizes/diameters of the certain rotor series. Secondly, the anchoring means 20' is fastened on the area 12 either by means of welding, gluing, soldering, riveting or by bolts or screws. Thirdly, the T-shaped locking block 132 is pushed into the T-shaped cavity formed at the first end of the internal cavity 150 of a turbulence element. Fourthly, the turbulence element 30' is placed on the rotor to house the anchoring means 20' such that the end of the element 30' opposite to the threaded hole 152 is first placed on the anchoring means 20' so that the inclined surface 128 of the anchoring means 20' meets the inclined surface 140 at the second end of the internal cavity 150 of the turbulence element 30'. Thereafter the first end of the turbulence element 30' is pushed against the rotor surface. This requires that the locking block is so far deep in the T-shaped cavity (left in FIGS. 7 and 8) that the tip of the anchoring means 20' is able to pass the tip of the locking block 132. And finally, a locking screw 130 is driven in the threaded hole 152 such that the tip of the screw 130 meets the locking block 132 and starts pushing the locking block 132 deeper (to the right) in the cavity 150 until the surface 136 of the locking block 132 meets the surface 126 of the anchoring means 20' and thus locks the turbulence element 30' and the anchoring means 20' together.

Referring to the embodiment of the present invention discussed in FIGS. 6, 7 and 8 it has to be understood that the invention may have several variations or modifications. For instance, the locking by using a screw may be arranged in a manner different from the one illustrated. An option is to arrange a mere hole (non-threaded) at the end surface of the turbulence element, and arrange a threaded blind hole in the locking block aligning with the hole in the end surface of the turbulence element. Now the locking screw should have a collar or flange cooperating with the inner end surface of the T-shaped cavity whereby driving the screw in one direction forces the locking block in one direction (to the right), and driving the screw in the opposite direction enables the moving of the locking block to the opposite direction i.e. to the left in the FIGS. 6, 7, and 8. Another option would be to arrange, again a mere non-threaded hole at the end surface of the turbulence element. However, in this option a separate nut or a corresponding threaded member is arranged at the end of the non-threaded hole preferably at the end of the T-shaped cavity whereby a screw may be used to operate the locking block in a manner originally discussed in connection with this embodiment.

It should also be understood that the embodiment discussed in FIGS. 6, 7, and 8 may be easily used with the shims 50 discussed in FIG. 5. In fact, the only limitation in using the shims is the height in which the inclined surfaces 126 and 128 extend radially. In other words, as long as the inclined surfaces of the turbulence element and the locking block meet the inclined surfaces of the anchoring means for a sufficient length the fastening of the turbulence element is ensured.

All the embodiments discussed above are based on providing the rotor surface at the positions where the turbulence elements are to be fastened with a smooth rotor surface area having a curvature similar to all rotor sizes. However, another option is to provide the rotor surface with a non-smooth surface configuration at the areas where the turbulence elements are to be attached. By arranging the configuration such that it is equal for all rotor sizes, only one type of turbulence element is needed for the entire rotor series. Thus the surface configuration may comprise machined or otherwise arranged grooves or depressions in the rotor surface which assist in positioning either the anchoring means or the turbulence element on the rotor surface. The surface configuration may also comprise ridges or protrusions, which are arranged on the rotor surface either alone or together with grooves or depressions. The advantage in arranging ridges or protrusions on the rotor surface is that the ridges or protrusions not only aid in positioning the turbulence element, or anchoring means, on the rotor surface but also may, if desired, facilitate in attaching the turbulence element or the anchoring means on the rotor surface, as the fastening may be done in non-radial direction, and directly between the turbulence element and/or anchoring means and the rotor surface i.e. the ridges or protrusions thereon. In other words, it is possible to arrange, or to machine, the ridges or protrusions to act as the anchoring means needed in the earlier embodiments of the invention. In fact, it is as simple as providing the protrusions with an appropriate shape matching the interior cavity of the turbulence elements, and means for attaching the turbulence elements thereto.

FIGS. 9*a* and 9*b* show two preferred embodiments for the surface configuration options. The configuration of FIG. 9*a* has three axial ridges and four grooves at the sides of the ridges. An option to manufacture this kind of a surface configuration is to first machine a first smooth surface on the rotor surface the machined area having an axial (in the direction of the rotor axis) length corresponding to the length of the area where the turbulence element is supposed to be fastened, and a depth extending to the tips of the ridges. The next step is to manufacture the four grooves deeper into the rotor surface such that the ridges are left inbetween. FIG. 9*b* has circumferentially running ridges and grooves. The manufacture of the surface configuration may be performed as discussed in connection with FIG. 9*a*, though also other manufacturing methods may be employed. Naturally, the direction of the grooves and ridges does not necessarily need to be circumferential or axial, but any direction is applicable.

In view of the above, it should be understood that the simplest embodiment of the present invention is a rotor having a different surface configuration at the areas where the turbulence elements are supposed to be attached than the rest of the rotor surface, and turbulence elements having a complementary surface configuration at the bottom surface thereof. Thus the various options for the different surface configuration start from a smooth or planar or flat surface to which specific anchoring means are fastened, and end up to a surface itself having anchoring means i.e. means in which the turbulence element may be fastened. Thus also there are options for the bottom surface of the turbulence element i.e. the bottom surface may be grooved, or it may have a cavity for the anchoring means of the rotor surface, just to name a few alternatives. In fact, a properly designed groove is considered a cavity for anchoring means. Thus the anchoring means may be either part or parts that is/are separately attachable on the rotor surface or material parts of the rotor shell extending radially outside the rest of the shell outer surface.

This far the manufacture of the rotor has not been discussed. However, the manufacture of the rotor relates to the invention, as different ways of manufacturing give different opportunities to manufacture the surface configuration of the areas where the turbulence elements are supposed to be arranged. There are in principle two options to manufacture the rotor. The first one is casting the rotor whereafter, depending at least on the quality of casting and on the position at a mill where the rotor is to be installed, the rotor surface may be machined more or less smooth. Now, the casting of the rotor makes it possible to provide the rotor surface with the surface configuration required by the areas where the turbulence elements are supposed to be arranged. Thus the normally round rotor surface may be provided with both depressions and protrusions, i.e. grooves, dents, ridges, bulbs etc. when casting the rotor. The casting makes it possible to arrange the areas to have a curvature smaller than that of the rest of the rotor surface i.e. to provide the rotor surface with a protrusion. After casting the rotor surface may again, and most often will, be machined to improve the surface quality.

The second option to manufacture the rotor is rolling the rotor from sheet metal having a desired thickness, and welding the ends of the rolled sheet together to form a rotor shell. Normally the rotor manufacture continues by welding end caps with bearing units to the axial ends of the rotor shell. However, there are some rotor types where one or both ends of the rotor are not closed, but the attachment of the rotor shell on its shaft is performed in some other appropriate way. Anyway, in view of the present invention, the attachment of the rotor on its shaft does not play any role. As to the surface configuration at the areas where the turbulence elements are to be arranged, a rolled rotor does not give as many opportunities as the cast rotor. In other words, there are only two further options, i.e. one is to machine one or more depressions of desired shape in the rotor surface, and the other is to press the depressions in the rotor surface. However, as the pressing may be done, in principle, from both sides of the rotor shell, it is possible to make protrusions extending radially outside the remaining rotor surface. However, the shapes of the protrusions made by pressing are more limited than that made by casting.

It should be understood that the above description discusses only a few preferred embodiments of the present invention without any purpose to limit the invention to the detailed structures disclosed above. Thus it is clear that, for instance, the shape, size and number of the turbulence elements on the rotor may be whatever the designer of the rotor sees practical. Also, the shape and size of the rotor may be whatever required by the specific application the rotor is designed for. Thus either the entire surface of the rotor or only a part (preferably, but not necessarily, in axial direction) of the rotor surface may be provided with areas having a certain surface configuration discussed in the present invention. In other words, for instance one longitudinal section of the rotor surface may be machined in the manner described above, whereas the other section's is/are, if needed, provided with turbulence elements attached by some other means on the rotor surface. Further, it is clear that the rotor of the invention may be used in connection with either inflow, or outflow screens. And, finally it has to be pointed out that the word 'rotor' covers above and in the claims all such means arranged in a screening device of pulp and paper industry that, on the one hand, creates turbulence in the fibre suspension to be screened, and, on the other hand, subjects the screening means, like a screen cylinder, to pressure pulses. Thus, as long as the 'rotor' is in relative movement in relation to the screening means, the turbulence creating and pressure subjecting means are called by the word 'rotor'. In other words, also stationary turbulence creating and pressure subjecting means arranged in cooperation with a rotating screening means are called 'rotors'.

The invention claimed is:

1. A rotor for a screening apparatus of the pulp and paper industry, the rotor comprising an at least partially closed rotationally symmetrical rotor body surface with at least one area having a surface configuration different from a remaining rotor body surface, the at least one area provided with means for attaching a turbulence element on and against the at least one area, wherein the means for attaching the turbulence element comprises anchoring means protruding from the at least one area, the anchoring means adapted for positioning the turbulence element on and against the at least one area.

2. The rotor as recited in claim 1, wherein the at least one area having the surface configuration different from the remaining rotor surface comprises boundaries, and wherein the anchoring means for the turbulence element is arranged within said boundaries.

3. The rotor as recited in claim 1, wherein the turbulence element comprises a cavity for housing the anchoring means.

4. The rotor as recited in claim 3, wherein the turbulence element is releasably held against the at least one area having the surface configuration by the anchoring means.

5. The rotor as recited in claim 3, wherein the turbulence element comprises a working surface, two end walls, and a bottom surface having an opening for the cavity, the opening surrounded by a continuous rim.

6. The rotor as recited in any one of claim 1, wherein the turbulence element comprises a working surface, two end walls, and a bottom surface, the bottom surface complementary to a surface of the at least one area.

7. The rotor as recited in claim 5, wherein at least one of the end walls of the turbulence element comprises an opening extending into the cavity.

8. The rotor as recited in claim 7, wherein the anchoring means comprises at least one opening at a surface of the anchoring means for fastening the turbulence element on the anchoring means.

9. The rotor as recited in claim 1, wherein the turbulence element is attached to the anchoring means by a dovetail joint.

10. The rotor as recited in claim 1, wherein the rotor further comprises at least one shim arranged between the turbulence element and a surface of the at least one area for raising the turbulence element to a desired height.

11. The rotor as recited in claim 10, wherein the at least one shim is wedge-shaped.

12. The rotor as recited in claim 1, wherein the anchoring means comprises a projection from a surface of the at least one area.

13. The rotor as recited in claim 12, wherein the projection is sized and positioned to be received by a cavity of the turbulence element.

14. The rotor as recited in claim 12, wherein the projection comprises a movable locking block adapted to retain the turbulence element.

15. The rotor as recited in claim 12, wherein a surface of the at least one area is adapted to position the turbulence element.

16. The rotor as recited in claim 15, wherein the surface of the at least one area comprises at least one of a depression and a protrusion adapted to position the turbulence element.

* * * * *

UNITED STATES PATENT AND TRADEMARK OFFICE

CERTIFICATE OF CORRECTION

PATENT NO. : 8,714,364 B2
APPLICATION NO. : 13/124541
DATED : May 6, 2014
INVENTOR(S) : Mathieu Hamelin It is certified that error appears in the above-identified patent and that said Letters Patent is hereby corrected as shown below:

IN THE DRAWINGS:

Delete Figures 9a and 9b and replace with attached Figures 9a and 9b.

Signed and Sealed this
Twenty-ninth Day of July, 2014

Michelle K. Lee

Michelle K. Lee
*Deputy Director of the United States Patent and Trademark Office*